United States Patent [19]

Sautter et al.

[11] 4,295,127

[45] Oct. 13, 1981

[54] INFORMATION DISPLAY DEVICE

[75] Inventors: Helmut Sautter, Ditzingen; Kurt Hurst, Stuttgart; Rainer Schink, Leonberg, all of Fed. Rep. of Germany

[73] Assignee: Robert Bosch GmbH, Stuttgart, Fed. Rep. of Germany

[21] Appl. No.: 954,639

[22] Filed: Oct. 25, 1978

[30] Foreign Application Priority Data

Oct. 25, 1977 [DE] Fed. Rep. of Germany ..... 2747794

[51] Int. Cl.[3] ..... G08B 5/00

[52] U.S. Cl. ..... 340/373; 340/764

[58] Field of Search ..... 340/373, 764, 378.5

[56] References Cited

U.S. PATENT DOCUMENTS

| | | | |
|---|---|---|---|
| 3,025,512 | 3/1962 | Bloechl | 340/764 |
| 3,036,300 | 5/1962 | Knight | 340/764 |
| 3,266,033 | 8/1966 | Frohbach | 340/373 |
| 3,267,455 | 8/1966 | McGuirre | 340/764 |
| 3,469,258 | 9/1969 | Winrow | 340/764 |
| 3,540,038 | 11/1970 | Taylor | 340/373 |
| 3,623,084 | 11/1971 | McCormick | 340/378.5 |
| 3,634,857 | 1/1972 | Pihl | 340/373 |
| 3,648,281 | 3/1972 | Dahms | 340/764 |
| 3,979,747 | 9/1976 | Candida | 340/373 |
| 4,040,193 | 8/1977 | Matsuda | 340/378.5 |

*Primary Examiner*—Harold I. Pitts

*Attorney, Agent, or Firm*—Frishauf, Holtz, Goodman & Woodward

[57] ABSTRACT

To provide for alphanumeric representation, for example to indicate speed limits, traffic signals and the like, a frame forming a flat plate and defining a display surface is formed with grooves in which electromagnetically operated indicating elements are positioned, the indicating elements having differently colored regions, the colors either matching or contrasting with that of the display surface so that, either, the region surrounding the indicating element will appear blank, or have the aspect of a bar; by arranging the elements in bar codes, alphanumeric information can be provided. The indicating elements are held in any one pivoted position by permanent magnets and moved between positions by a pulse applied to a solenoid to change the position of the element from one to another stable, magnetically biassed position.

4 Claims, 21 Drawing Figures

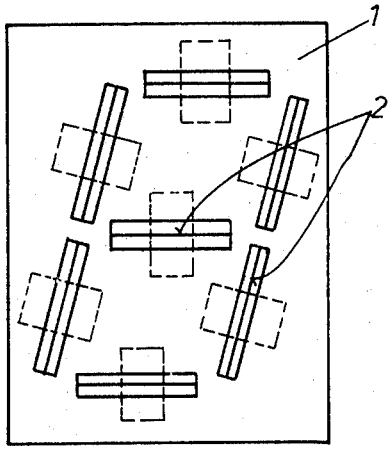
Fig. 1
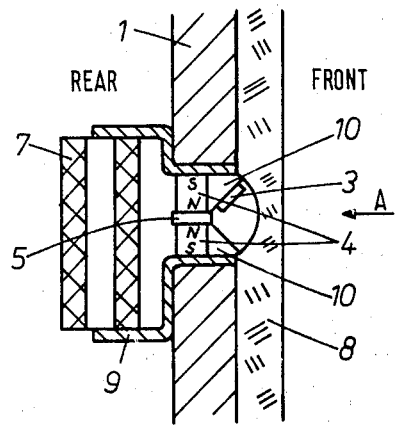
Fig. 2
Fig. 3
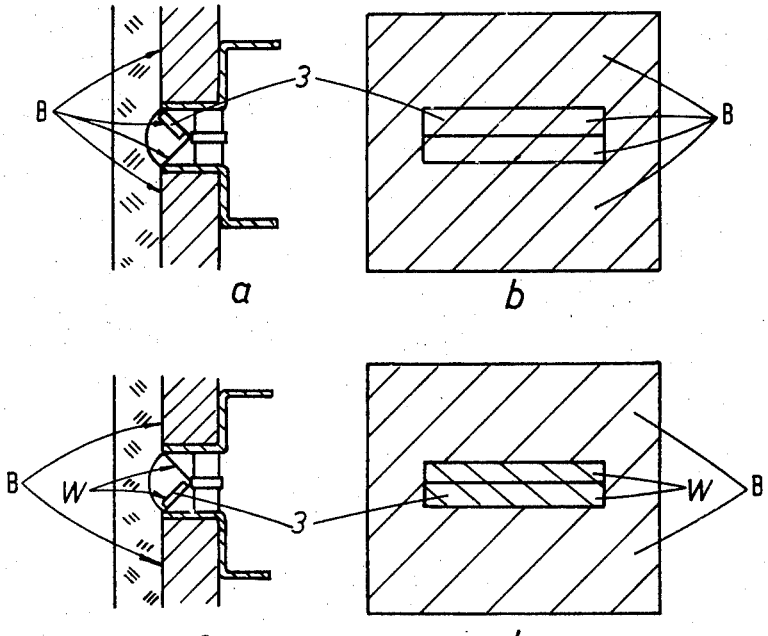
Fig. 4 a) b)

a) b) c)

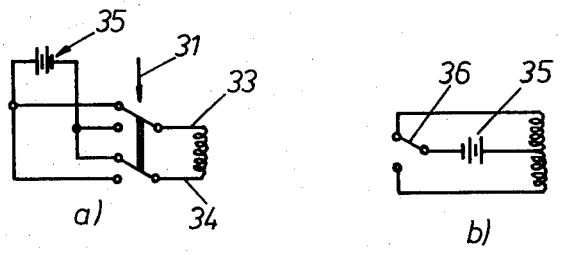
Fig. 14
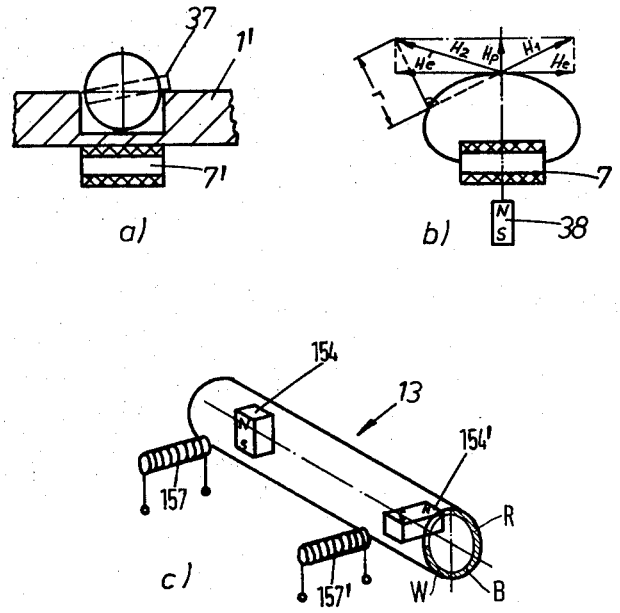
Fig. 15
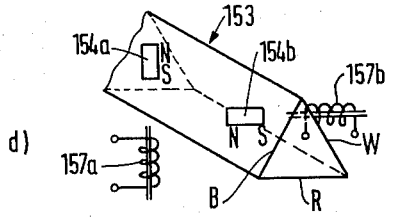

INFORMATION DISPLAY DEVICE

The present invention relates to an information display device, and more particularly to an information display apparatus suitable as a changeable road sign or automobile traffic indicator having a movable element which can provide variable information in dependence on changing conditions, for example to indicate changing speed limits, accidents, icing conditions, and the like. The display device is, however, also broadly applicable to many other displays, for example destination indication of vehicles, trains, aircraft, time and temperature displays, and the like, particularly if of large size to provide high visibility in open spaces.

BACKGROUND AND PRIOR ART

Information display elements are becoming increasingly important to provide optical indication of rapidly changing conditions. Opto-electronic indicators are frequently used. There is, however, an increasing demand for sturdy, extremely large display devices, particularly to permit use outdoors, with minimum power consumption, to provide indication of traffic conditions, for example for variable indication of different speed limits, directional indications, warnings of traffic jams, accidents ahead, and the like. Various types of indicators have been proposed which are suitable for large-area display of variable information, particularly of alphanumeric symbols. Usually, such elements are display devices arranged in a pattern with white or light colored flaps which are located in suitable openings within a frame or within an indicating surface that can be flipped out of the field of vision on such a manner that they are no longer visible to an observer. The observer will then only see the background of the display frame or surface which is colored to match the remainder of the surface, thus observing only a dark opening without contrasting information. Such display indicators are not entirely suitable, particularly for outdoor use; they are comparatively costly and not as reliable as desired. The angle of vision for good recognition of the displayed information—and non-recognition if no information is to be displayed—can become critical. A wide angle of vision which permits recognition is frequently particularly important in display devices to indicate road traffic conditions since the possible locations for such indication devices are frequently limited and can often not be selected only from the standpoint of optimal recognition.

THE INVENTION

It is an object to provide an information display device, particularly one which is suitable as a traffic display device to provide large-area display information which is simple, sturdy, and permits recognition of the displayed information over a wide angle of visibility; and which, further, is economical in construction as well as in operation, and requiring minimal power for change of information and, preferably, no power during display.

Briefly, a frame is provided forming a display surface, on which a movable indicating element is located. The movable indicating element may be in form of a plate having two surfaces, or in form of an enlongated cylinder or prism showing two or more surface regions. One of the surface regions is colored to match the color of the display surface; the other surface region or regions are of contrasting color. Preferably, the indicating elements are located in a standard 7-element or 14-element pattern to provide alphanumeric information. The movable element and the frame, or a fixed portion thereof, have cooperating electromagnetic operating means, preferably a permanent magnet associated with the movable element and electromagnet coils located on the frame and so arranged that movement of the movable element can be controlled by current pulses, which may be in opposite directions through the coil. The element will hold a position into which it has been placed due to the action of the permanent magnet thereof, but can change position, for example to display the reverse side of a plate, or the obverse side of the surface of a cylinder upon energization of the coil causing change-over.

Drawings, illustrating examples of preferred embodiments:

FIG. 1 is a schematic front view of a first preferred embodiment;

FIG. 2 is a fragmentary vertical sectional view through the arrangement of FIG. 1 in the region of one display element;

FIG. 3 shows, in views a and b, a cross section and a top view, respectively, of an indicating element of FIG. 1 in one operating position;

FIG. 4 shows, in views a and b, a cross section and top view of an indicating element of FIG. 1 in another operating position;

Figure 8:
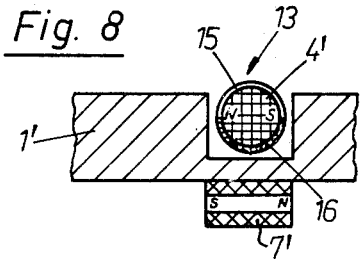
FIG. 8 is a fragmentary cross-sectional view through a third embodiment of an indicating element of the display device.
Figure 10:
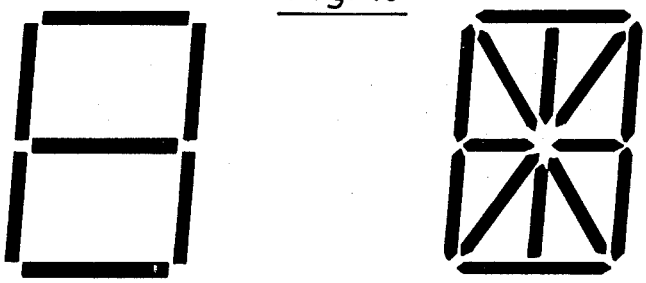
Figure 11:
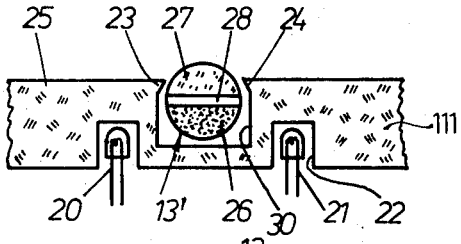
Figure 12:
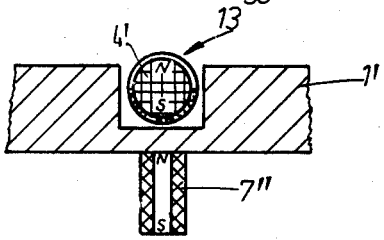
Figure 13:
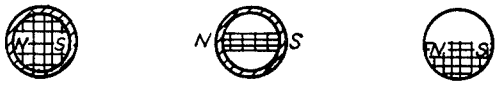
Figure 16:
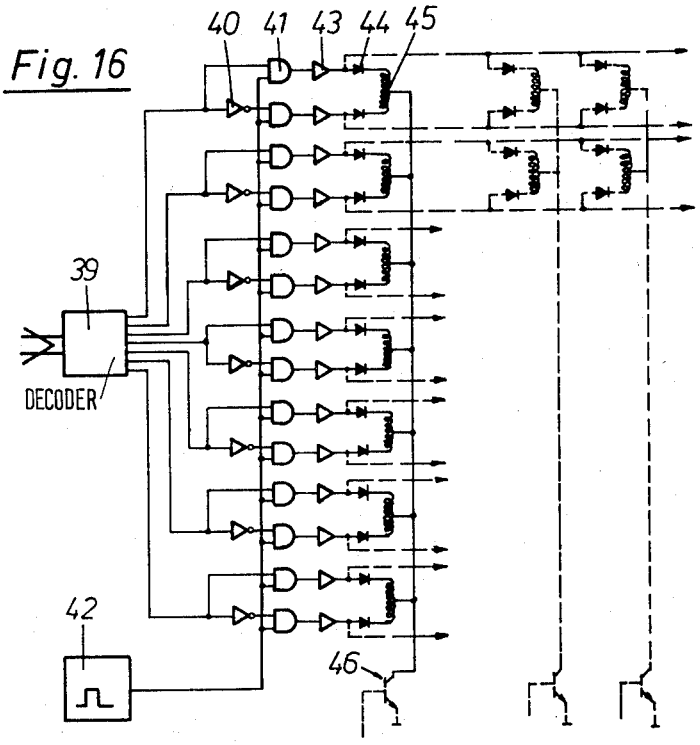
Figure 17:
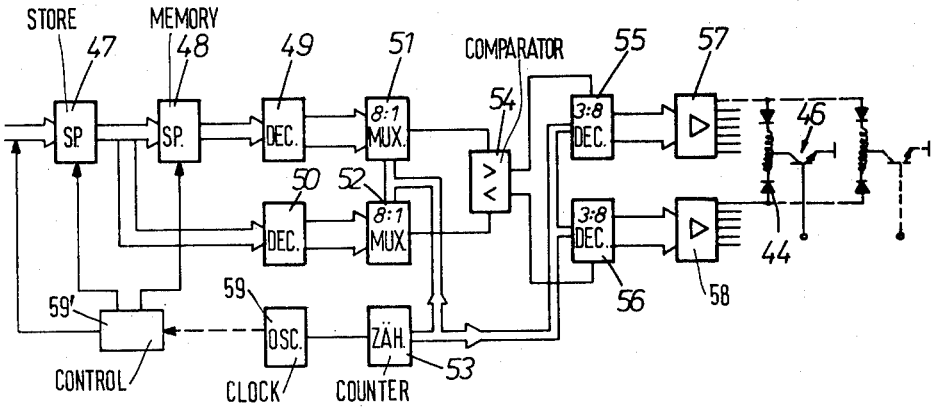

FIG. 10, in views a and b, shows preferred patterns to arrange a plurality of indicating elements on a display device to represent numbers in the arabic numering system, or to provide display of alphanumeric characters;

FIG. 11 is a fragmentary cross-sectional view similar to the view of FIG. 8, illustrating another embodiment;

FIG. 12 is a fragmentary cross-sectional view similar to the view of FIG. 8 and illustrating yet another embodiment;

FIG. 13, in views a, b and c, illustrates various embodiments of cross-sectional arrangements for the movable element of the display device for use in the arrangement of FIGS. 8 to 12, for example;

FIG. 14 shows a simplified circuit arrangement for energization of the display device to effect change-over of the display, in which view a illustrates a connection using a double-pole, double-throw (DPDT) switch; and view b illustrates the arrangement using a center tapped winding with a single-pole, double-throw (SPDT) or transfer switch;

FIG. 15 illustrates, highly schematically and partly in perspective, arrangements to illustrate the principle to determine the final positioning of the movable element in which view a shows a cylindrical indicator with a stop;

view b is a schematic illustration showing the use of an additional biassing permanent magnet;

view c is a schematic illustration, partly perspective, showing multiple coil-permanent magnet arrangements for a cylindrical movable element, and view d shows one arrangement for a prismatic movable element, in triangular cross section;

FIG. 16 is a schematic circuit diagram of one embodiment of an energization arrangement to provide for change of an alphanumeric information display; and FIG. 17 is a schematic circuit diagram of another embodiment of a circuit to control the display device.

Embodiment of FIGS. 1–4: A frame 1 which provides a display surface at the front thereof, generally in plate-like form, is formed with grooves or notches 2 arranged in the customary 7-segment pattern for information display of numeric digits.

FIG. 2 clearly shows that the grooves 2 are formed as through-slots extending through the plate-type frame 1. At the back side of the plate 1, that is, at the left side of FIG. 2, a magnet system including two permanent magnets 4 and a divider strip 5 are arranged. The permanent magnets 4 are placed with the polarization as shown, that is, with like poles adjacent each other. The strip 5 is of ferromagnetic material. The magnets 4 are bounded laterally by yokes or pole shoes 9 of a solenoid 7. The pole shoes 9 extend up to the front edge of the frame 1. Prismatic elements 10, triangular in cross section, are so arranged within the slots that the grooves 2, when looked at from the front, have a V-shaped cross section. A movable indicating element 3, formed as an elongated plate of ferromagnetic material, is located in the groove 2. The plate 3, as best seen in FIGS. 3 and 4, can be placed in two stable end positions in which it is engaged either with the upper one or the lower one of the poles shoes 9 of the solenoid 7.

If the electromagnet is not energized, the plate 3 will be placed against the base of one of the triangular prismatic elements 10. The short sides of the triangular elements 10 are placed against the inner sides of the pole shoes 9 and against the upper sides of the magnets 4, respectively. In this position of the plate 3, a closed magnetic circuit will be established between one pole (N) of the magnet 4 associated with the respective side of the groove 2, through the center strip 5, plate 3, pole shoe 9, and then to the other pole (S) of the associate permanent magnet 4.

Operation: Let is be assumed that the plate is positioned as shown in FIG. 2 or, as shown in FIG. 3 in which, in view a, the illustration is similar to that of FIG. 2, except that the front and rear are reversed. If the magnet 7 is energized with a suitable energization current which is so polarized that the pole shoe 9 with which the plate 3 is engaged—in FIG. 2 with the right edge—so that the pole shoe will have the same polarity as the strip 5, that is, will have the polarity North, then the plate 3 will be repelled—due to the connection with permanent magnet 4—and will flip with its lower edge over to the other side of the V-shaped groove 2. At that position, the pole shoe 9 at the lower side, which then will have a polarity of S, will attract the forward edge of the plate 3. The pivot or flip axis of the plate 3 essentially is along the longitudinal plane of the groove 2, roughly at the level of the upper edge of the magnet 4 or of the strip 5, respectively. The energization current for solenoid 7 can now be disconnected; plate 3 will remain in its new position since the magnetic circuit for the other permanent magnet 4 will now be closed. The ferromagnetic plate 3 may for example and preferably be a thin strip of steel. It thus can be changed over in position by a short-time, limited pulse through the magnet 7 with an energization voltage of proper polarity, so that it will be placed in one of two stable terminal positions. It will remain in this terminal position, without energization of the solenoid 7, until a voltage of opposite polarity is appled to the electromagnet 7. Thus, no electrical energy is needed by the display device until the display is to be changed. The construction is simple and sturdy, is essentially fool-proof and trouble-free and permits inexpensive manufacture, since there are no critical tolerances to be observed. The reliability of the device can be enhanced by providing a transparent cover 8 at the front side, for example a glass plate, a plastic plate, or the like, to protect the grooves 2 and the plate 3 from environmental conditions.

The direction of view of the device is, of course, from front towards the rear, that is, in the direction of arrow A (FIG. 2).

The front side of the frame plate 2, forming the display surface, is colored in one color, for example black; one of the surfaces of the plate 3 is then colored in the same color, again for example black, and the half of the prism 10 which is exposed when the black side of the plate 3 is visible is also painted black. Thus, for one terminal position of the plate 3—as shown in view b of FIG. 3—the display surface of frame 1 and the visible surface of the groove as well as of the plate 3 will be uniform, thus displaying a flat or blank black surface to a viewer looking in the direction of arrow A. This is generally shown in FIG. 3, view b. The black color is schematically indicated by B in FIGS. 3 and 4.

The other half of the groove, in which the other prismatic element 10 is located, is painted with a color contrasting with the color of the display surface, for example white, as indicated by W in FIG. 4. When the plate is put into the position shown in FIG. 4, the white surface of the respective prism 10 and the back side of the plate 3 will be visible so that a contrasting white strip will be visible, clearly differentiated from the background of the display surface of the frame 1.

The display device preferably uses a plurality of display units arranged in a customary segmental pattern, for example the 7-segment pattern shown in FIG. 1 and view a of FIG. 10. By suitable positioning of the plates 3, various numbers can be displayed, suitable, for example, for indication of maximum speed. The plates 3 can be of substantial length and the plates or frames 1 of substantial size to provide for clearly visible large-area displays suitable for traffic indications. The operating elements themselves, that is, elements 4, 5, 7, 9 for the plates 3, extend only over a portion of the length of the plate; they are indicated in broken lines in FIG. 1. They are, preferably, located roughly intermediate the length of the plates 3 along a limited portion thereof.

The arrangement of the pattern of the grooves 2 in the frame 1 forming the display surface can be as desired; various types of display elements may be constructed.

Figure 6:
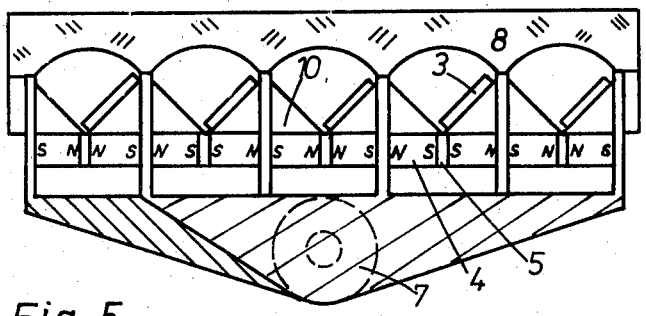
FIG. 6 is a cross section through the device of FIG. 5 taken along line VI—VI of FIG. 5.
Figure 7:
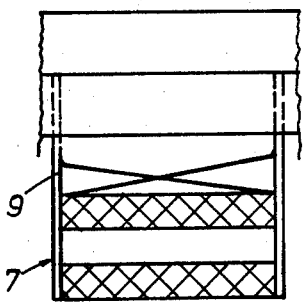
FIG. 7 is a detail view to illustrate the operation of the device of FIGS. 5 and 6.
Figure 5:
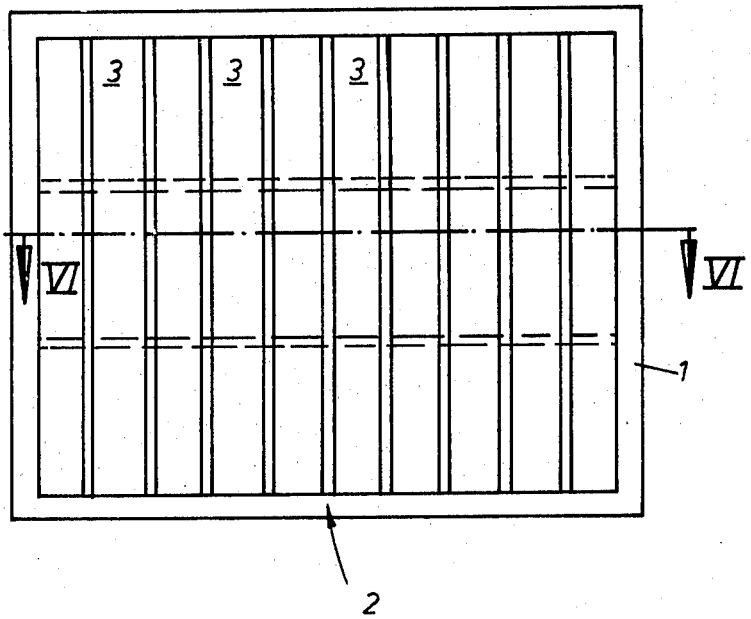
FIG. 5 is a top view of a second preferred embodiment of an indicating display device.

FIGS. 5 to 7: The grooves 2 can be arranged in parallel to each other, spaced closely from each other and so arranged that some, or all the plates 3 are changed in position by means of a common solenoid 7 from one terminal position to another in order to provide for large-area symbol display, for example to indicate symbolic traffic signs. These symbolic traffic signs can be applied, in strips, on simultaneously visible main surfaces of the plates 3 and the background surfaces of the grooves 2 within the grooves, that is, on the then visible prisms 10. All the plates 3 can be moved from one terminal position to the other terminal position by a common solenoid 7 (FIG. 6), the plates 3 providing traffic or other warning indication or other information as desired, the information being displayed until a next change is commanded without requiring any continuous energy supply during the display itself. This is a particularly advantageous feature of this device since it permits the use of the device in locations where network power is not available and battery supply must be resorted to, for example at work zones or construction sites where traffic signs must be powered by batteries.

In the embodiment of FIG. 5, the frame 1 forms a plurality of narrow extending strips between which the respective prisms 10 and the plates 3 are located—see FIG. 6. The poles shoes 9, extending from the solenoid 7, extend to all the grooves 2, as seen in FIG. 7. Preferably, the frame 1 is extended rearwardly to form a holding or support arrangement for the entire device which, preferably, is covered with a cover plate 8 of glass or plastic for environmental protection.

The movable display element need not be a plate, but may have other cross-sectional form, for example that of a cylinder or of an elongated prism with two, three, four or possibly more display surfaces.

Figure 9:
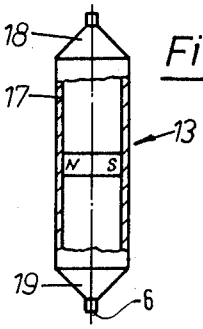
FIG. 9 is a detail view of the indicating element as such, partly broken away.

Embodiment of FIGS. 8 and 9: The movable indicating element is a cylindrical roller 13, suitably journalled in bearings located in frame 1'. The roller 13 has permanent magnets 4' located therein which, upon electromagnetic interaction with solenoid 7', can be placed in one or the other stable terminal position, offset with respect to each other by about 180°. The terminal positions of the roller 13 can be fixed by associating solenoid 7' with pole shoes or a suitable core which is magnetically coupled to the permanent magent 4' in the roller 9 so that the end positions are predetermined. The solenoid 7' is secured to the frame 1' which, at the front side thereof, forms a display surface or which can be grooved with closely adjacent grooves to provide a display similar to that shown in FIG. 6. The surface of the roller 13 is subdivided into two regions 15, 16 which are differently colored or have different indicia thereon. The boundary lines of the regions 15, 16 extend parallel to the axis of rotation 6 of the roller 13. Various types of indications can also be obtained; for example, the region 16 which is the lower region in FIG. 8 can be colored to have the same color as the upper side or display surface of the frame 1', the other region 15 of the roller 13 being colored to contrast with the color of the frame 1'. The observer of the device as illustrated in FIG. 8 will then observe a white strip or bar in the position where the roller 13 is located, and corresponding to the region 15. The white indication will clearly contrast from the background of the display surface which, for example, can be black. When the roller is pivoted or rotated by 180°, the observer will only see an essentially uniform black surface, namely the surface of the frame 1' and the black surface of the region 16. There will be practically no distinction between the surface of the frame 1' and that of the region 16. The observer will thus not recognize any symbol display.

Various rollers can be combined similar to the arrangement of FIG. 1, or FIGS. 5 to 7, for example. Each one of these rollers will have its own operating element associated therewith. The arrangement of the rollers can be in various patterns, for example as shown in FIG. 10, view a, for designation of arabic digital numbers or, as shown in FIG. 10, view b, to provide for selective alphanumeric representation in the arabic numbering and Roman letter system, and having overall 14 movable elements or segments.

The rollers 13—FIG. 9—can be constructed in various ways. For example, they can be metal injection castings in which a permanent magnet 4' is embedded in the body of the roller itself, the outsides of which are differently colored, painted or lacquered in order to distinguish the differently colored regions 15, 16; alternatively, differently colored adhesive foils may be secured to the surface of the rollers 13. The cylindrical portion 17 can also be made separately from the two bearing ends 18, 19 of the roller. Such a composite construction has the advantage that the material for the cylindrical portion 17 can be selected with a view to optimal visibility and color effect, whereas the material for the ends 18, 19, including the bearing pins, can be selected to meet the requirements of low wear and friction for the bearings. The entire roller 13, or only the cylindrical portion 17, can also be assembled from axially split halves, held together by adhesives, or by ring-bushings, for example used also for the bearings at the ends 18, 19.

The display device is legible only when suitably illuminated. In the simplest case, a light can be provided in advance of the reading surface thereof, or the display device can be constructed to reflect incident light, for example from the headlights of a vehicle. In accordance with a feature of the invention, however, light sources can be integrated with the display unit itself, so that it is self-illuminating.

Embodiment of FIG. 11: Light sources 20, 21, which may be incandescent lamps of fluorescent tubes, are integrated with the display device which, in general principle, is similar to the device explained in connection with FIGS. 8 and 9. The base or frame plate 111 is made of transparent material, formed at the back side with notches or grooves or recesses in which the light sources, for example incandescent lamps or fluorescent tubes are embedded or inserted. Light emanating from sources 20, 21 penetrates in the region of the notches or grooves 22 into the material of the frame or support plate 111. It can exit from the support plate 111 at light-emitting beads 23, 24 located along the longitudinal edges of the roller 13. All other surfaces, including the front surface of the support plate or frame 111, are coated with an opaque coating which, preferably, is internally reflective. This coating may also have a white coating underneath, which at the outside is, however, painted with a dark color to provide for optimum contrast with the colored portion of the roller 13'. One half 26 of the roller 13' is made of opaque material. The other half 27 is made of transparent material, the boundary surface between the two halves 26, 27, preferably including a reflective intermediate layer 28.

In the position shown in FIG. 11, light from the lights beads 23, 24 can penetrate into the upper half 27 of the roller 13 and, if necessary and provided, after reflection in the intermediate layer 28 is radiated outwardly towards the front, so that the display element formed by the roller is clearly visible even at night. Radiation of the light forwardly is enhanced by the reflective boundary layer 28 which, also, can provide for a contrasting color indication for best visibility in daylight. The opaque half 26 may be made of a material or contain a material which enhances reflection and/or dispersion of the light impinging on or derived from the transparent half 27 of the roller 13'. The outer surface of the half 26 of the roller 13' then should be coated to be opaque.

Various modifications may be made; for example, a single suitably strong light source may be used instead of the light sources 20, 21, arranged to illuminate a transparent portion or the entire transparent back side of the frame 111 forming the display surface at the other side thereof.

The rollers 13, 13' can be constructed to have various shapes. They need not be round or circular in cross section; they may have an oval, square rectangular or triangular cross section. If made with a triangular section, the terminal positions incude a pivot angle of only about 120°. The subdivisions of the variously colored ranges 15, 16 then are matched suitably to the respective cross-sectional shape of the movable elements 13, 13', respectively.

Change-over, that is, rotation of the movable elements 13, 13' as described, is effected by cooperation of the permanent magnet 4 with the solenoids 7'. The core of the solenoids 7' is located such that the longitudinal axis of the excitation winding is parallel to the back side or lower side of the frame 1 and essentially perpendicular to the pivot axis 6 (FIG. 9) of the roller 13. If the solenoid 7 is so arranged, the permanent magnet 7 will orient itself with respect to the frame 1 such that the common center line will pass through its poles N, S, and parallel to the lower side of the frame 1. The poles of the permanent magnet 4 then should extend to the boundary lines between the two differently colored regions 15, 16.

Embodiment of FIG. 12: It is not necessary that the longitudinal axis of the solenoid is parallel to the back side of the display surface; the solenoid 7" can also be so located that its major axis is perpendicular to the back side of the frame 1', or 111, respectively. If so arranged, the connecting line between the poles N, S of the permanent magnet 4' will align itself perpendicularly with respect to the back side of the frame 1'. The position of the poles of the permanent magnet 4' then must be shifted with respect to the regions 15, 16 since the poles must be directed towards the center line of the regions 15, 16 so that the respective region will be clearly visible at the front side of the frame 1, forming the display surface. As shown in FIGS. 8 and 9, permanent magnet 4' can be constructed as a relatively short cylindrical magnetic element extending for a short axial distance within the roller 13, and located in an opening of the roller 13, preferably, but not necessarily, in the center thereof. This construction of the permanent magnet 4 is also shown in view a of FIG. 13. The permanent magnet 4 may, however, also be constructed differently, for example in form of a transversely positioned plate, as seen in view b of FIG. 13. Another possibility to provide a permanent magnet arrangement associated with the roller is to make one half of the roller, for example the dark half of a material which, itself, can be magnetized; such materials are, for example, a thermoplastic in which a ferrite powder is introduced as a filler. Thus, the various arrangements as shown in FIG. 13 may be used; those arrangements shown in views a and b can utilize permanent magnets made of customary permanent magnet material, such as Alnico alloys, sintered ferrite, a CoSm sinter material, or a plasto-ferrite material on an iron or CoSm base.

Solenoid 7 preferably is cored; the core can consist of customary soft-iron characteristic magnetic material. A torque is effective on the roller 13 or on the permanent magnet 4' associated therewith only during the time when excitation current flows through the winding of solenoid 7'. It is desirable to construct the core of solenoid 7 of a material having high remanence, for example an Alnico alloy, so that the magnetic effect is retained even after disconnection of the excitation current which causes change-over of the movable indicating elements from one position to another.

Rotation of the movable element 13, or flip-over of plate 3 (FIGS. 1–4) from one terminal position to another requires reversal of polarity of the excitation current through the solenoid 7 during sequential switching operation. This current must be sufficient in order to magnetize the core, particularly if the core material is one of high remanence. The reversal of direction of current flow through the solenoid can be effected with various types of circuits, of which FIG. 14 shows two suitable arrangements. View a illustrates a DPDT transfer switch 31, so that the terminals 33, 34 of the solenoid coil can be connected to a battery 35 for current flow in respectively reversible direction. The solenoid can, of course, also be constructed in form of a center-tapped winding, with transfer of direction of current flow being effected by an SPDT switch 36. Various other types of switching arrangements, including semiconductor switching, may be used.

If a soft-iron core is used for the solenoid 7, then the excitation current must flow at least until the roller 13 or the plate 3, respectively, has received sufficient torque energy to reach the new terminal position. Depending on the size of the movable element, frictional losses and the like, current pulses of about ½ second duration are usually needed. A suitable excitation for movable elements from which typical road sign indications can be derived requires approximately 200 A-turns.

The core of solenoid 7 can also be made of a material of intermediate or even high remanence; under such conditions, a higher instantaneous current is required for remagnetization in reverse direction, but for a shorter period of time. For example, to remagnetize a suitable core with an Alnico alloy, about 50 kA/m are required. To obtain such a field strength, about 6–9 A must flow through a coil of about 80 turns, but the time is extremely short—in the order of about 1 ms., usually even less. The required torque is then obtained by the remaining magnetic force due to the remanence of the then remagnetized or reversely magnetized core.

Neglecting friction, which is practical in most installations if the bearings are of low-friction type, the forces acting on the rollers of the arrangement of FIGS. 8 and 9 are, essentially, only magnetic forces. The roller 13 will thus turn until the magnetic torque disappears. Upon remagnetization in reverse direction of the solenoid 7, that is, upon energization in reverse direction, the field will change over by exactly 180°. The resulting torque will still be zero. The roller 13 will, however, be in unstable equilibrium. It will change its position only if it is deflected from its—unstable—equilibrium position by a random outside force, for example due to vibration. To prevent operation based on random events, and to ensure reliable flip-over or rotation of the roller 13, it is desirable to provide an initial rotary torque which differs from torque-zero, so that, upon change-over, a certain starting torque will always be available.

Generation of starting torque, FIG. 15: Various arrangements can be made to provide a starting torque, illustrated in FIG. 15. View a shows a cam or projection 37 associated with the roller 13 (or 13') which engages a stop or abutment, or the frame 1' itself before it reaches the stable equilibrium position. The permanent magnet 4' thus cannot align itself exactly parallel to the axis of the magnet 7' so that, upon reverse polarization of exciting current, a starting torque is provided. The projection cam or stop element 37 additionally acts as a damper to suppress oscillations about the equilibrium position which may occur if the bearings for the roller 13 are of especially low-friction characteristic.

FIG. 15, view b, illustrates generation of a magnetic biassing force to provide a starting torque and, additionally, to hold the roller in position against random movement when in a terminal position. A permanent magnet 38 is so located with respect to the solenoid 7 that the magnetic fields of the permanent magnet and of the solenoid 7 will superimpose. Preferably, the elecromagnet 7 and the permanent magnet 38 are located close to each other, the fields of the permanent magnet and the electromagnet both affecting the magnet within the movable element 13, 13'. The exact positioning of the additional permanent magnet 38 is not critical provided that parallel position with respect to the axis of the magnet 7 is prohibited. In the arrangement as shown, permanent magnet 4 of a roller 13 will align itself in parallel to the resulting field $H_1$ of the composite fields $H_e$ and $H_p$ of the electromagnet 7 and of the additional permanent magnet 38, respectively. Upon change of polarity of current flow through the solenoid 7, the direction of the field $H_e$ will change by 180° to the position shown by the vector $H'_e$. The vectorial direction of the field from the permanent magnet has remained the same. The new resulting field $H_2$ will have an angle with respect to the previous resulting field strength $H_1$ which is other than 180°. Accordingly, a permanent magnet 4' in the roller 13 which has positioned itself parallel to the major vectorial direction of the field $H_1$ will receive a torque which is determined by the value of $H_2$ and the effective lever arm r.

In another form, as illustrated in view c of FIG. 15, two permanent magnets 154, 154' are located in each one of the rollers 13, 13', respectively. The permanent magnets 154, 154' are respectively offset with respect to each other by 90°, as best seen in view c of FIG. 15. Each one of the permanent magnets 154, 154' cooperates with a solenoid 157, 157'. The solenoids are preferably cored to provide a holding position. Change-over from the position shown in view c of FIG. 15 into one reversed with respect thereto by 180° is carried out in two steps. Let it be assumed that the roller 13 is in the position shown. Both solenoids 157, 157' are de-energized. Upon energization of the solenoid 157 only, roller 13 will rotate by 90° so that the magnet 154 will align itself with the solenoid 157. The solenoid 157 is then de-energized and solenoid 157' is energized in a direction of current flow opposite that of its previous energization, causing the roller 13 to continue to rotate by a further 90° to a new terminal position. In this arrangement, the starting torque is the maximum torque. Change-over of the roller 13 between its positions requires, however, two current pulses, or double-phase control.

It is also possible to provide displays of more than two colors. In a variation of the embodiment shown in view c of FIG. 15, and specifically illustrated in view d, the surface of the movable element is subdivided into three colored zones, for example into a red zone R, a black zone B, and a white zone W. In view d, the movable element is shown as a prism 153 with equilateral triangular cross section, although the element may, of course, also be cylindrical as shown in view c with three colored zones, for example red, black, and white, each covering 120° of the circumference. The positioning of the respective zones can be obtained by suitably sequenced and relatively arranged excitation of the two magnets 157, 157' to change the equilibrium position of the roller 13—view c of FIG. 15—over an angle of rotation between zero degree and 180° in any desired position, so that the visible portion of the roller will either match that of the background of the frame display surface, for example black, or contrast therefrom, for example in red or white. The amplitude of current flow through the respective coils 157, 157' can be readily adjusted to provide for intermediate positions of the roller 13. In the embodiment shown in view d, the coils **157*a*, 157*b* are arranged to be perpendicular to the respective sides of the triangle forming the cross section of the movable element; only two such coils are shown for clarity of the drawing. In this arrangement, one or two of the coils which are not in alignment with one of the magnets are energized, thus providing sufficient flux to furnish a starting torque to turn the element 153 until a respectively selected magnet 154 is in alignment with the respective coil 157*a*, or magnet 154*b* in alignment with coil 157*b***, as shown.

The display device is optimally used if the overall construction is reliable and simple; thus, it requires not only a simple and sturdy electromechanical and magneto-mechanical portion—as described in connection with the examples above—but also a reliable control circuit which can control the display unit to carry out the change-over of the display with low requirements on elements and energy. Low energy requirements are particularly important when the display device is used for traffic indication since, frequently, no network power supplies are available, for example when temporary detour or construction signs are to be controlled, so that signalling arrangements must be energized by batteries. Two suitable, and preferably used control circuits will be described and explained in connection with FIGS. 16 and 17.

The control circuits utilize the characteristic of the device that the last-commanded indication will remain as the indication even after current is disconnected, that is, after the device is de-energized. To control the device, it is necessary only to control switch-over, so that only current pulses are required, the length and intensity of which depend on the core material of the solenoids, or, more accurately, on the entire electromagnetic circuit. Two control circuits will be described, utilizing as an example a 7-segment digital numerical indication, as illustrated in FIG. 10, view a. One of the control circuits—FIG. 16—is comparatively simple and is optimized with respect to simplicity of components and network; the other circuit, FIG. 17, is optimized with respect to minimum power requirements, although the circuit sophistication is thereby increased.

Control circuit, FIG. 16: Binary coded signals to control display of a specific numerical digit are supplied to a decoder 39. The output of the decoder then provides control signals to respective solenoids associates with respective movable indicating elements to command change-over, or not, so that the eventual output display will be as desired in the 7-segment pattern. Seven control signals are provided, one for each of the segments or, respectively, elements of the display unit. Since each segment requires a pulse for change-over into one of the two terminal positions—"visible" and "invisible", the decoding is so arranged that the seven control signals provide at the output of the decoder complementary outputs, obtained by means of an inverters 40. The seven direct, that is, non-inverted control signals from the decoder 39 as well as the seven inverted control signals from the outputs of the inverters 40 are applied to the input of respective fourteen AND-gates 41, the second input of which is connected to a common supply line and then to the output of a monostable flip-flop 42, providing a pulse. The AND-gates 41 and the monostable FF 42 provide decoded, partially inverted control signals of defined length which are connected through driver or power stages 43 and isolating diodes 44 to respective terminals of the excitation winding 45 of the seven solenoids, each associated with at least one of the seven segments of a single-digit numerical indicator. If only a single digit is to be indicated, then the isolating diodes 44 can be omitted, and the center terminal of the excitation winding 45 can be connected directly to a source of reference potential. If a multiple-digit indicating display device is needed, which operates in multiplex mode, then the center taps of the excitation windings 45, for any one of the digits, are connected through a common line to the switching path of a switch 46, preferably a transistor switch which, upon selective control thereof, connects the common line to reference potential, as indicated in broken lines in FIG. 16. The excitation windings 45 of associated or similar segments of any one of the segmental elements of a multi-digit indication are connected in parallel. In a multi-digit indication, the separating or isolating diodes 44 prevent spurious energization, the particular digit being selected by energization of the respective switching transistor 46 associated with a respective digit.

Operation: Upon energization of the respective AND-gates 41, as decoded in decoder 39 by the pulse source 42 and controlled to conduction of the respective transistor 46 associated with a particular digit, current flow in one, or the other (reverse) direction through the respective winding 45 is controlled, so that the respective movable elements of the display device of any specific digit are commanded to be visible, or invisible, or to remain in the previous position or change over.

Embodiment of FIG. 17: The control circuit provides a control pulse only for those segments which actually must be changed over. Control of the various digits of a multi-digit number as well as control of the various segments of any one of the digits, thus is effected in multiplex mode. This circuit is particularly appropriate if the control currents or excitation currents for the respective digits are comparatively high, since in this type of control the transistor switch 46, which controls the selection of a particular one of various symbols, is loaded only by a single control current, appropriate to any one element. In the embodiment of FIG. 16, however, the sum of a plurality of control currents can flow over the transistor switch 46 since a plurality of segments are simultaneously changed over. For example, if the excitation winding 45 requires a current pulse of 8 A, the transistor switch 46 of FIG. 16 is loaded with maximum 56 A; in the circuit of FIG. 17, the loading is only 8 A. If the display includes alphanumeric segmental display units, as shown, for example, in FIG. 10, view b, then difference in loading is even more startling—112 A for the circuit of FIG. 16 compared to 8 A for the circuit of FIG. 17. The control of the switch-over in the circuit of FIG. 17 then will be carried out sequentially, so that the lower current will flow for a longer period of time, however.

Binary coded control signals, derived as in FIG. 16, are applied to a storage element 47 for storage; a second storage element 48, formed as a memory, for example a random-access memory (RAM) has contained therein the information relating to those numbers or symbols of a multiple-digit indication which is to be controlled at any one operating cycle. The contents of both the storage element 47 and the memory 48 are decoded in separate decoders 49, 50. The output signals are converted into serial signals by 8:1 de-multiplex circuits 51, 52. The de-multiplex, or parallel-serial converters are controlled by a counter 53 which, in turn, is controlled by a clock oscillator 59. The outputs from the circuits 51, 52 are applied to the inputs of a comparator 54. The counter 53 preferably is a ring counter which, under control of the clock 59, also controls operation of two further de-multiplex, or parallel-serial converters 55 providing three-from-eight de-multiplex outputs. The outputs of the circuits 55, 56 are activated by the outputs from comparator 54. The circuit 55 provides an output signal only if a respective segment of a previously indicated digit has to be changed over, that is, must not be visible. Thus, output 55 is so arranged that it changes a respective segment from "visible" to "invisible". The de-multiplexer 56 is activated in the reverse case, that is, when a previously "invisible" segment of the pattern—see FIG. 10—is to be made "visible". The circuits 55 and 56, as well as the circuits 51, 52 are synchronously controlled, so that each output of the circuits 55, 56 will have, unambiguously, a segment associated therewith. The outputs from the circuits 55, 56 are connected through amplifier or power stages 57, 58 and isolating diodes 44 to the excitation windings 45 of respective solenoids associated with respective movable indicating elements, the center tap of the respective windings 45 again being connected through common lines to switches 46 to associate the outputs from the circuit of FIG. 17 with respective digits of a multiple-digit display device. This portion of the circuit corresponds to the portion of the circuit explained in connection with FIG. 16.

The outputs from circuits 57, 58 thus are selectively sequentially directed to respective solenoids of the respective movable indicating elements under control of the counter and only those elements which require change-over will have current applied thereto, in one or the other direction, depending on which one of the circuits 55, 56 is energized at any one time. A control unit 59' controls entry of a commanded number into the store 47, to provide a commanded display and transfer of read-out information from memory 48.

The indicating device is simple and sturdy and has numerous advantages with respect to known indicators which are particularly important for use with traffic information, and when placed out-of-doors.

A multiplicity of color combinations can be used, and the indication can readily be so arranged that it provides colors which are fade-resistant, clearly visible also in bright sunlight, possibly reflective, and permanent even under long use when operated in the open. The size of the sign is selectable at random since the display elements, and specifically the moving indicating elements, can be selected to be of any suitable size. This permits legibility of direction signs even from long distances and also from the side, since the vision angle for legibility is wide and not restricted by deep openings. The information can be read in bright surrounding, for example when illuminated by direct sunlight, while being equally readily adaptable for additional artificial illumination so that they can be used as road signs, visible also at night. The display device of FIG. 8 does not require any particular cover or glass shield so that, if it should be subject to an impact, for example upon occurrence of an accident, no flying-glass danger will result. It is desirable, however, to provide some environmental protection which can readily be obtained by inexpensive plastic. The device is insensitive to ordinary temperature variations encountered in apparatus installed inside or outside, and fully operable in a range of from −30° C. to +90° C. A distinct advantage of the display device is that the last-entered indication or display will remain on the display panel without requiring maintenance power so that, if there is malfunction in the control system, or failure of the power supply, the display last entered will continue to be displayed. Normal change-over is simple.

The control system permits multiplex operation, particularly by utilizing the remanence characteristics of the core of a solenoid, even with high frequency.

Operating energy is required only when change-over of the indication of the display is required. The average energy consumption thus is low, particularly if change of display occurs only in longer time intervals. Any one excitation solenoid for a typical road sign requires only about 50 mW for each switching pulse. For control of switching in second-intervals, requiring, for example, thirty switching pulses in 10 seconds, 150 mW are required. For counting in minute-intervals, 2.5 mW. In comparison, a luminescent diode indicator requires approximately 250 to 300 mW; a liquid crystal indicator of comparable size requires 0.1 mW, both power requirements being independent of the change-over timing or rate.

The device can be manufactured simply by ordinary sheet metal or other construction technology, and does not require expensive or exotic materials; as a specific advantage, no toxic or dangerous materials are needed, and the manufacturing technologies are all well known, being concerned primarily with magnets and plastics handling.

The indicator is sturdy and easily manufactured; it does not contain any small parts, and particularly no parts having specific details or dimensions requiring accurate tolerances or which are of small size so that they are difficult to make or parts difficult to handle. Electronic control elements, for example the various components represented by the blocks of FIG. 17, are readily available as commercial articles of composite circuits.

The device is particularly suitable for large-area outdoor display used in traffic and directional signs; it may, of course, also be used for other information display, and in connection with "traffic" information, indications of aircraft destination and timetables, indications for bus or train departures, and the like, may also be used. When used internally of vehicles or aircraft, the low power requirement, and particularly the absence of power requirement when no change-over is needed, is especially important to provide for displays when the power plants for the respective vehicles or aircraft are disconnected. Various changes and modifications may be made within the scope of the inventive concept.

We claim:

1. Information display device having a frame (1) furnishing a display surface;

a plurality of movable indicating elements (3, 13) arranged on said frame in segmental patterns representative of alphanumeric characters, and formed with at least two surface regions, one surface region having a visible aspect which essentially matches the visible aspect of the display surface and another, or other surface regions which have visible aspects contrasting with the visible aspect of the display surface, said indicating elements being movable to display respective surface regions so that, when any indicating element is in a first terminal position in which the visible aspects of the display surface and of the surface element matches, no display visible, but when the indicating element is in a second terminal position in which the visible aspects of the display surface and of the element differ, the element is visually recognizable, and comprising magnetic means (3, 4, 9) biassing said movable indicating element into one, or the other of said terminal positions and establishing the first and second positions as stable terminal positions;

control means (39–44, 46; 47, 57) to selectively place said elements in either of said stable first or second terminal positions to provide a selective display of alphanumeric characters;

electromagnetic operating means (3, 4, 7) including at least one permanent magnet (4) and one solenoid-electromagnet (7) located, respectively, on the display element and on the frame and being connected to and controlled by said control means to control movement of the display element between said stable first and second terminal positions;

said movable indicating elements are elongated, essentially rectangular plates (3);

the frame (1) is formed with an essentially V-shaped elongated groove, the longitudinal edge of said plate being fitted in the V-shaped groove and located adjacent the apex thereof;

said permanent magnet (4) acting on said plate to hold said plate in position in the absence of energization of said solenoid-electromagnet (7), energization of said solenoid electromagnet causing pivoting of said plate about a pivot axis adjacent the apex of the V to move the plate from one, to the other of said stable terminal positions.

2. Device according to claim 1, wherein the display surface includes a region (10) matching the outline of said plate and having said contrasting visible aspect, said region of contrasting visible aspect being covered by the plate when the plate is in one position, and exposed to view by the plate when the plate is pivoted into the other position in which the contrasting visible aspect of the plate is visible.

3. Device according to claim 1, wherein the electromagnetic operating means comprises a solenoid (7);

pole shoes (9) extending approximately up to the open end of the V-shaped groove (2);

two permanent magnets (4) located at the root of the V-shaped groove with opposite poles fitted against each other, and magnetic guide means extending from said fitted opposite ends to the apex or root of the groove;

and triangular prism elements (10) located within the groove and defining the V-surface thereof, the base surfaces of the triangular prisms defining the legs of the V;

said elongated plate (3) having a width which approximately equals the distance between the electromagnetic guide means (5) and the pole shoes (9) at the edge of the groove, and being made of a magnetically responsive material, the plate extending essentially parallel to the leg of the V from the apex to an edge of the groove and being held in position by magnetic interaction between said permanent magnets, the pole shoes, the magnetic flux guide means and the magnetic responsiveness of said plate.

4. Device according to claim 1, wherein said electromagnetic operating means comprises at least one permanent magnet (4) and one solenoid-electromagnet (7).

* * * * *

UNITED STATES PATENT AND TRADEMARK OFFICE

CERTIFICATE OF CORRECTION

PATENT NO. : 4,295,127

DATED : October 13, 1981

INVENTOR(S) : Helmut SAUTTER et al

It is certified that error appears in the above—identified patent and that said Letters Patent is hereby corrected as shown below:

Please cancel Claim 4 and replace by Claim 14 as follows:

Device according to claim 21, wherein the frame includes transparent material;

further including illuminating means located in light-transmitting position with respect to the frame, [the frame including transparent material] to [receive light from said illuminating means] illuminate the transparent material of the frame;

and light-emitting regions (23, 24) located on said frame and positioned adjacent the movable indicating element (3, 13) to illuminate the indicating element by light transmission from the illuminating means (20, 21) through at least a portion of the frame to the light-emitting region.

Signed and Sealed this

*Twenty-third* Day of *March 1982*

[SEAL]

*Attest:*

GERALD J. MOSSINGHOFF

*Attesting Officer*

*Commissioner of Patents and Trademarks*